United States Patent [19]

Ramaiah et al.

[11] Patent Number: 4,866,342

[45] Date of Patent: Sep. 12, 1989

[54] METAL HALIDE LAMP WITH IMPROVED LUMEN OUTPUT

[75] Inventors: Raghu Ramaiah, Painted Post; Matthew A. George, Horseheads, both of N.Y.

[73] Assignee: North American Philips Corporation, New York, N.Y.

[21] Appl. No.: 198,704

[22] Filed: May 17, 1988

Related U.S. Application Data

[63] Continuation of Ser. No. 947,333, Dec. 29, 1986, abandoned.

[51] Int. Cl.[4] ..... H01J 61/20

[52] U.S. Cl. ..... 313/639; 313/640

[58] Field of Search ..... 313/637-640, 313/571

[56] References Cited

U.S. PATENT DOCUMENTS

| | | | |
|---|---|---|---|
| 3,521,110 | 7/1970 | Johnson | 313/642 X |
| 3,959,682 | 5/1976 | Wesselink et al. | 313/640 |
| 3,983,440 | 9/1976 | Scott et al. | 313/566 |
| 4,232,243 | 11/1980 | Rigden | 313/634 X |
| 4,594,529 | 6/1986 | de Vrijer | 313/571 |

FOREIGN PATENT DOCUMENTS

| | | | |
|---|---|---|---|
| 7126310 | 7/1971 | Japan | 313/637 |

*Primary Examiner*—Donald J. Yusko
*Assistant Examiner*—Michael Horabik
*Attorney, Agent, or Firm*—John C. Fox

[57] ABSTRACT

The luminous efficacy of a metal halide lamp containing sodium iodide and scandium iodide is increased, while color rendering index is maintained or improved by the addition of critical amounts of thallium iodide.

2 Claims, 1 Drawing Sheet

METAL HALIDE LAMP WITH IMPROVED LUMEN OUTPUT

This is a continuation of application Ser. No. 947,333 filed Dec. 29, 1986, now abandoned.

BACKGROUND OF THE INVENTION

This invention relates to metal halide lamps, and more particularly relates to such lamps containing sodium and scandium metal halides having improved lumen output.

Metal halide lamps were introduced commercially in the United States in the early 1960's. In appearance, these metal halide lamps resemble a mercury vapor lamp, having an inner quartz arc tube containing a fill of an arc-sustaining material and surrounded by an outer glass envelope. As in the mercury lamp, the metal halide lamp's arc tube fill includes a rare gas for starting and a quantity of mercury. However, the lamp's emission spectrum is primarily due to the presence in the arc tube fill of one or more metal halides, usually iodides. These metal halides are responsible for a much higher luminous efficacy and color rendering capability of the lamp output than is possible for the mercury vapor lamp. The luminous efficacy, color rendering index and other lamp output characteristics may be varied, depending upon the particular composition of the metal halides in the arc tube fill. It has been said that there are more than 50 different metal halides which may be used alone or in combination in metal halide lamps. However, those combinations which have enjoyed commercial success fall into three categories. An indium-thallium-sodium lamp and a thorium-thallium-sodium lamp were introduced in the mid-1960's by General Electric and Sylvania and were marketed under the trademarks Multivapor and Metalarc, respectively. The thorium-thallium-sodium lamp was later superceded by a scandium-sodium lamp. In addition, a dysprosium-thallium-indium lamp was introduced by Westinghouse and marketed under the trademark BOC. *Electric Discharge Lamps,* John F. Waymouth, The MIT Press, page 211 (1971).

Of these systems, the thallium-indium-sodium combination appears to offer superior color rendering properties with the sodium contributing to the yellow portion of the spectrum, thallium to the green and indium to the blue. Such a combination is currently enjoying commercial success in Europe. However, in the United States, the sodium scandium lamp has become practically universally accepted, due to its very good luminous efficacy, (typically 85 to 90 lumens per watt) and long operating life (typically 10,000 to 15,000 hours).

Despite the commercial success of metal halide lamps, it is a general objective to further increase the luminous efficacy, color rendering index and operating life of these lamps. For example, in British Patent No. 1,125,063, lithium was added to an indium-thallium-sodium halide lamp in order to improve color rendering by increasing emission in the red portion of the spectrum. In U.S. Pat. No. 3, 521,110, tin, antimony or bismuth is added to an indium-thalliumsodium halide lamp in order to extend operating life.

Because of its acceptable luminous efficacy and superior operating life, and its wide commercial acceptance in the United States, it would be desirable to further improve upon the sodium-scandium metal halide lamp.

Accordingly, it is an object of the invention to increase the luminous efficacy of a sodium scandium metal halide lamp.

It is also an object of the invention to increase the luminous efficacy of such a lamp, while maintaining or even increasing the color rendering index for such a lamp.

SUMMARY OF THE INVENTION

In accordance with the invention, there is provided a metal halide lamp comprising a sealed inner arc tube, electrodes positioned in spaced apart orientation within the arc tube, a sealed outer glass envelope surrounding the arc tube, electrical lead-in conductors passing through the outer glass envelope and the arc tube and electrically connected to the electrodes, and a discharge sustaining fill within the arc tube consisting essentially of a rare gas, mercury, and the halides of sodium and scandium, characterized in that the fill additionally contains thallium halide in the mole ratio of sodium halide to thallium halide of about 280:1 to 75:1, whereby the luminous efficacy of the lamp is increased without substantially adversely affecting the color rendering index of the lamp.

In accordance with a preferred embodiment, the mole ratio of sodium halide to thallium halide is maintained within the range of about 260:1 to 240:1, whereby both the luminous efficacy and the color rendering index of the lamp are improved.

BRIEF DESCRIPTION OF THE DRAWING

The single FIGURE is a front elevation view partly in section of a metal halide lamp in accordance with the invention.

DESCRIPTION OF THE PREFERRED EMBODIMENT

Figure 1:
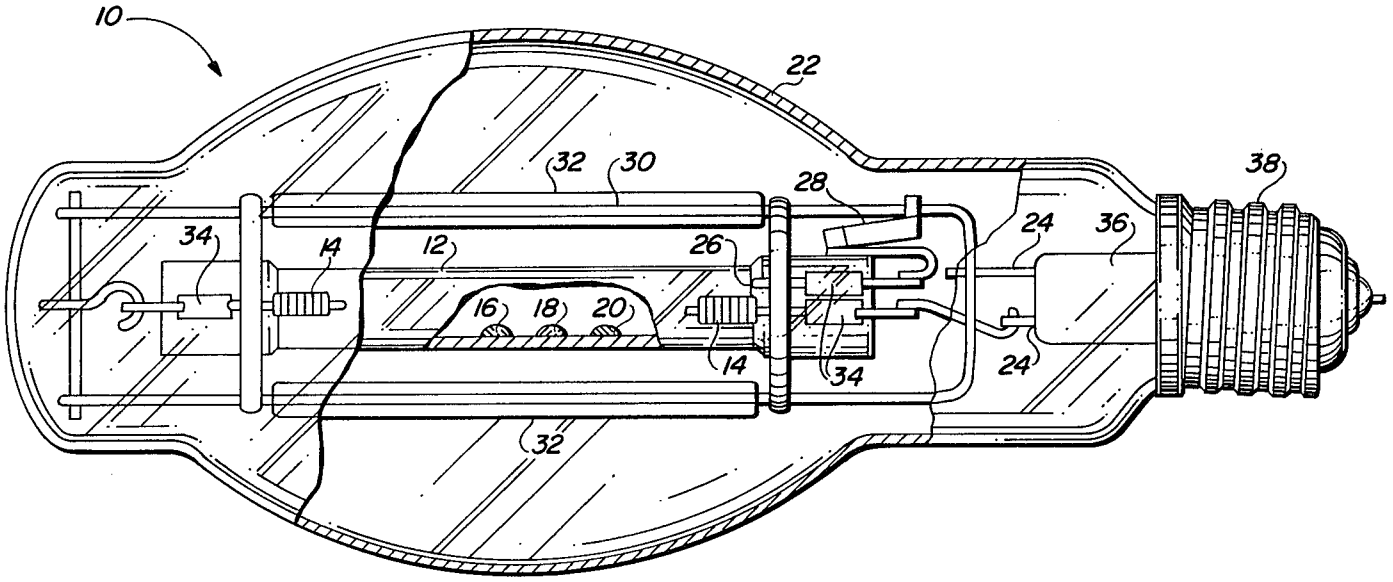

Referring now to FIG. 1, metal halide lamp 10 is similar in construction to the conventional high pressure mercury vapor lamp, and comprises a sealed inner envelope or arc tube 12 having electrodes 14 disposed near opposite ends of the arc tube, and separated by a distance predetermined to sustain a vapor discharge. A quantity of mercury 16 and a smaller quantity of an inert ionizable starting gas, such as argon, are contained within the arc tube 12. Other noble gases can be substituted for the argon, and the gas pressure can be varied.

The charge of mercury 16 is present in a predetermined amount as is known from the prior art. See, for example, the discussion beginning at col. 2, line 53 of U.S. Pat. No. 3,979,624. Also included within the arc tube 12 are alkali metal halide 18 of sodium iodide, sodium bromide or mixtures thereof, as well as scandium halide 20 of scandium iodide, scandium bromide or mixtures thereof. As is known, the molar ratio of total alkali metal halide to total scandium halide should be maintained within the range of from about 50:1 to 25:1, below which the lamp output tends to become bluish in color and above which the lamp output tends to become pinkish. The total amount of alkali metal halide plus scandium halide desirably should not exceed about 0.004 millimoles per millimeter of spacing between the arc tube electrodes.

In order to protect the arc tube 12 as well as to conserve heat, a transparent sealed outer envelope 22 is spaced from and surrounds the arc tube 12. The space between the arc tube 12 and the outer envelope 22 can either be evacuated or gas filled, depending upon the particular application and lamp operating conditions. Electrical lead-in conductors 24 are sealed into both the inner arc tube 12 and the outer envelope 22 and serve to electrically connect the operating electrodes 14 to a conventional external power source.

A starting electrode 26 is also included within arc tube 12 and connects through a starting resistor 28 to one end of the electrical lead-in conductors 24. Arc tube 12 is maintained in spaced relationship from outer envelope 22 by means of a conventional supporting frame 30 which frame may be encased with dielectric sleeves 32 in the known manner. Ribbon conductors 34 serve to facilitate hermetic sealing of the lead-in conductors into the arc tube ends. The lead-in conductors are sealed into the outer envelope 22 by means of a conventional re-entrant stem press 36 and connect to a standard mogul base 38 for connection to a standard screw base socket, not shown. Lamp 10 is designed to operate at a power of 400 watts.

The arc tube envelope 12 is generally formed of quartz. Alternatively, the arc tube envelope may be formed of a high density sintered polycrystalline or single crystalline alumina. In such case it is not practical to seal the ends of the arc tube by pressing. Therefore, the alumina arc tube is sealed using separate end caps. The arc tube 12 has a volume of about 12.3 cubic centimeters, and the spacing between the ends of the electrodes 14 is about 44.5 millimeters.

In accordance with the invention, there is also present within the arc tube a small additive quantity of thallium halide, either iodide or bromide, or a mixture of the two. Such addition has been found to be effective in increasing the luminous efficacy of the lamp, without substantially adversely affecting the color rendering index of the lamp. For this purpose, thallium iodide is added in an amount corresponding to a mole ratio of sodium halide to thallium halide of from about 280:1 to about 75:1, below which there is insufficient thallium present to cause any appreciable increase in luminous efficacy, and above which the color rendering index of the lamp is adversely affected.

In accordance with a preferred embodiment of the invention, the mole ratio of sodium halide to thallium halide is maintained within the range of from about 260:1 to 240:1, within which range not only the luminous efficacy but also the color rendering index of the lamp is improved.

As used herein, the term "color rendering index" is meant to refer to a standard color rendering test described in *Color,* NBS Special Publication 440, by K. L. Kelty and D. B. Judd, and *IES Lighting Handbook,* Reference Volume, 1981, Ed. John E. Kaufman. As is known, in such test the output of the lamp is compared visually with a series of standard color chips, each chip having an assigned index number and a weighted value. A weighted average of 8 different indices is taken as the color rendering index.

The following example shows the effect on lumen output, color rendering index, and other lamp output characteristics of various levels of thallium iodide additions to a sodium-scandium lamp.

EXAMPLE

Four lots, designated A through D, of 400 watt metal halide lamps were prepared containing a fill of about 51.5 milligrams of mercury, 35 torr of argon, 46 milligrams of sodium iodide, 1 milligram of scandium iodide and 6 milligrams of mercury iodide. Lot A, containing six lamps, was designated the control, while various amounts of thallium iodide were added to lots B, C and D, each containing five lamps, as shown in the following Table I.

TABLE I

| Lot | No./Lot | TlI (mg) |
|---|---|---|
| A | 6 | 0 |
| B | 5 | 0.4 |
| C | 5 | 0.8 |
| D | 5 | 1.2 |

The lamps were operated for a period of 100 hours, and were then evaluated by measuring the operating voltage (V), the luminous efficacy as indicated by the output in lumens per watt (LPW), the color rendering index (CRI), the color temperature (CCT), and the standard color coordinates (X and Y). The results are given in the following Table II in which the average values (—) for each lot are given together with the standard deviation (SD) for that lot.

TABLE II

| Lot | $\overline{V}$ (S.D.) | $\overline{LPW}$ (S.D.) | $\overline{X}$ | $\overline{Y}$ | $\overline{CCT}$ (S.D.) | $\overline{CRI}$ (S.D.) |
|---|---|---|---|---|---|---|
| A | 136.2 (3.4) | 85.4 (2.7) | .391 | .394 | 3850 (175) | 58.6 (4) |
| B | 136.6 (3.5) | 94.6 (1.7) | .384 | .420 | 4167 (58) | 62.0 (2) |
| C | 131.8 (1.9) | 96.2 (2) | .381 | .434 | 4326 (140) | 58.5 (1) |
| D | 28.8 (3.4) | 97.3 (2) | .374 | .448 | 4528 (112) | 55.2 (2) |

As can be seen from Table II, lot B, which contained 0.4 milligrams of thallium iodide, exhibited an average luminous efficacy of 94.6 lumens per watt. This is about an 11% increase over the average value of 85.4 lumens per watt which was obtained for the control lot A. The color rendering index for lot B was 62.0, which is about a 6% increase over the color rendering index of 58.6 for the control lot A. As can be seen, the luminous efficacy continues to increase with increased levels of thallium iodide and is 97.3 lumens per watt for lot D, a 14% increase over that of control lot A. However, the color rendering index is seen to decrease with increasing thallium iodide content beyond the 0.4 milligram level of lot B. However, for lot D, the CRI has decreased only about 6% to 55.2 from 58.6 for control lot A. This lamp could find use in special applications such as sports lighting, in which the higher amount of green emission is desirable.

In order to determine the ability of the lamps of the invention to maintain their high luminous efficacy over an extended period of operation, Lots A and B were evaluated after 2,500 hours and after 5,000 hours of operation, by measuring operating voltage (V), lumens per watt (LPW), and color temperature (CCT). Lamp maintenance (% M) was calculated according to the formula:

$$\% M \text{ at } X \text{ Hours} = \frac{LPW \text{ at } X \text{ Hours}}{LPW \text{ at } 100 \text{ Hours}}$$

The results are given in the following Table III in which the average values (—) for each lot are given together with the standard deviation (SD) for that lot.

TABLE III

| Lot | Burn Hrs. | $\overline{V}$ (S.D.) | $\overline{LPW}$ (S.D.) | $\overline{CCT}$ (S.D.) | % M |
|---|---|---|---|---|---|
| A | 2,500 | 139 (3.1) | 72.3 (2.4) | 4024 (154) | 84.6 |
| A | 5,000 | 137.7 (2.0) | 62.4 (9.8) | 3952 (218) | 73.1 |
| B | 2,500 | 139.4 (2.1) | 79.5 (0.7) | 4469 (78) | 84.0 |
| B | 5,000 | 142.0 (2.6) | 71.5 (2.8) | 4350 (91) | 75.6 |

From the table, we see that the maintenance of the lamps with the thallium iodide addition (Lot B) is comparable to that of the lamps with no addition (Lot A) after 2,500 burn hours, and slightly better after 5,000 burn hours. In fact, at 5,000 hours, the Lot B lamps show 14.6% higher LPW than the Lot A lamps, compared to 11% higher at 100 hours.

The color shifts of the lamps from Lot A and Lot B are comparable.

What is claimed is:

1. A metal halide lamp comprising an inner sealed arc tube, electrodes positioned in spaced apart orientation within the arc tube, a sealed outer glass envelope surrounding the arc tube, electrical lead-in conductors passing through the outer glass envelope and the arc tube, the electrical lead-in conductors being electrically connected to the electrodes, and a discharge sustaining fill within the arc tube consisting essentially of a rare gas, mercury, and the halides of sodium and scandium, characterized in that the fill additionally contains thallium halide in the mole ratio of sodium iodide to thallium iodide of about 260:1 to 240:1.

2. The metal halide lamp of claim 1 wherein the mole ratio of sodium halide to scandium halide is within the range of from about 50:1 to 25:1.

* * * * *